US008801873B2

(12) United States Patent
Miyanishi et al.

(10) Patent No.: US 8,801,873 B2
(45) Date of Patent: Aug. 12, 2014

(54) CARBURIZED STEEL PART

(75) Inventors: Kei Miyanishi, Tokyo (JP); Toshiharu Aiso, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 157 days.

(21) Appl. No.: 12/989,970

(22) PCT Filed: Mar. 29, 2010

(86) PCT No.: PCT/JP2010/002264

§ 371 (c)(1),
(2), (4) Date: Oct. 28, 2010

(87) PCT Pub. No.: WO2010/116670

PCT Pub. Date: Oct. 14, 2010

(65) Prior Publication Data

US 2011/0036463 A1 Feb. 17, 2011

(30) Foreign Application Priority Data

Mar. 30, 2009 (JP) ..... 2009-083228

(51) Int. Cl.
*C23C 8/22* (2006.01)
*C22C 38/00* (2006.01)

(52) U.S. Cl.
USPC ..... 148/319; 148/320

(58) Field of Classification Search
None
See application file for complete search history.

(56) References Cited

U.S. PATENT DOCUMENTS

2005/0161125 A1* 7/2005 Ozaki ..... 148/334
2005/0247377 A1* 11/2005 Takayama et al. ..... 148/319

FOREIGN PATENT DOCUMENTS

| | | | | |
|---|---|---|---|---|
| CN | 1648276 A | | 8/2005 | |
| EP | 1548142 A1 | | 6/2005 | |
| JP | 3-64500 A | | 3/1991 | |
| JP | 9-59756 A | | 3/1997 | |
| JP | 9-256102 A | | 9/1997 | |
| JP | 11-77116 A | | 3/1999 | |
| JP | 11-80882 A | | 3/1999 | |
| JP | 11-236646 A | | 8/1999 | |
| JP | 2004-204263 | * | 7/2004 | ..... C22C 38/00 |
| JP | 2007-23310 A | | 2/2007 | |
| JP | 2007-177317 A | | 7/2007 | |
| JP | 2007-332438 A | | 12/2007 | |
| JP | 2009-228049 | * | 10/2009 | ..... C22C 38/00 |
| WO | 02/44435 A1 | | 6/2002 | |

OTHER PUBLICATIONS

Ochi et al, JP 2004-204263 (2004).*

(Continued)

*Primary Examiner* — Yoshitoshi Takeuchi
(74) *Attorney, Agent, or Firm* — Birch, Stewart, Kolasch & Birch, LLP

(57) ABSTRACT

The present invention provides a carburized steel part obtained by subjecting a base material to a cutting operation and a carburizing operation, in which the base material includes chemical components of: C: greater than 0.3 but less than or equal to 0.6% by mass; Si: 0.01 to 1.5% by mass; Mn: 0.3 to 2.0% by mass; P: 0.0001 to 0.02% by mass; S: 0.001 to 0.15% by mass; N: 0.001 to 0.03% by mass; Al: greater than 0.06 but less than or equal to 0.3% by mass; and, O: 0.0001 to 0.005% by mass, with a balance including iron and inevitable impurities, and in which the carburized steel part has a hardness of HV550 to HV800 in a surface layer portion, and a hardness of HV400 to HV550 in a core portion.

12 Claims, 4 Drawing Sheets

(56) References Cited

OTHER PUBLICATIONS

Conversion Chart of Vickers Hardness (HV) to Rockwell C (HRC) (http://www.taylorspecialsteels.co.uk/pages/main/conchart.htm).*
International Search Report, dated Jun. 15, 2010, issued in corresponding International Application PCT/JP2010/002264.
Office Action issued in related Japanese Patent Application No. 2010-529027 on Sep. 28, 2010.
Chinese Office Action for Chinese Application No. 201080001338.9 dated Nov. 21, 2012 with English translation.

* cited by examiner

CARBURIZED STEEL PART

TECHNICAL FIELD

The present invention relates to a carburized steel part having excellent machinability before carburization and static bending strength.

The present application claims priority based on Japanese Patent Application No. 2009-083228 filed in Japan on Mar. 30, 2009, contents of which are cited herein.

BACKGROUND ART

At a time of sudden vehicle starts or sudden vehicle stops, excess external forces are applied to parts used in a machine construction, especially, differential gears, transmission gears, carburized toothed shafts or other gear parts. At this time, a high degree of stress is generated within a base portion of tooth of the gear part. As a result, fall or breakage of tooth may occur at the base portion of the tooth because of receiving a static bending stress. Therefore, it has been strongly demanded that the static bending strength be improved, especially for the differential gears. In the past, a case hardening steel containing about 0.2% of C according to JIS-SCr420, JIS-SCM420 or the like has been generally used for a base material (steel before carburization is applied) for the gear part as described above. This makes it possible to lower the hardness of the base material, and maintain the machinability before the carburization, for example, at the time of performing a cutting operation such as teeth cutting, which is implemented before the carburization. Then, a carburizing operation (carburizing and hardening operation, and low-temperature tempering operation at around 150° C.) is applied after the cutting operation to transform a metal structure of a surface of the carburized steel part into a tempered martensite structure (troostite structure or sorbite structure) containing about 0.8% of C. FIG. 7 is a diagram showing a relationship between a depth from the surface and Vickers hardness of the carburized steel part obtained by the processes as described above. As shown in FIG. 7, the hardness of the surface layer portion can be strengthened through the processes as described above, and hence, the high-cycle bending fatigue strength and the wear resistance of the gear part can be improved by implementing the processes as described above to the gear part.

Patent Literatures 1-3, which will be described in detail later, disclose techniques for improving the static bending strength of the carburized steel part.

Patent Literature 1 discloses a carburized steel part manufactured from a base material containing chemical components of 0.1-0.3 wt % of C, 0.35-1.1 wt % of Mn, 0.1-1.1 wt % of Cr, 0.6-1.7 wt % of Mn+Cr, and 0.001-0.005 wt % of B, in which the amount of C in a surface portion of a carburized and hardened layer is 0.6-1.1 wt %, and a troostite area fraction in the carburized and hardened layer is 5-50%.

Patent Literature 2 discloses a carburized steel part manufactured from a base material containing chemical components of 0.1-0.3 wt % of C, 0.5-1.3 wt % of Mn, 0.1-1.1 wt % of Cr, 0.9-1.9 wt % of Mn+Cr, and 0.001-0.005 wt % of B, in which the amount of C in a surface portion of a carburized and hardened layer is 0.6-1.1 wt %, and a troostite area fraction in the carburized and hardened layer is 5-50%.

Patent Literature 3 discloses a method in which a carburizing operation is applied to a formed product made by using alloy steel containing 0.5% or more of Ni, and a region from a surface of the carburized formed product up to a depth of 20 micrometers or more is removed by electrolytic polishing and the like.

RELATED ART LITERATURE

Patent Literature

Patent Literature 1: Japanese Unexamined Patent Application, First Publication No. H11-80882

Patent Literature 2: Japanese Unexamined Patent Application, First Publication No. H9-256102

Patent Literature 3: Japanese Unexamined Patent Application, First Publication No. H3-64500

SUMMARY OF THE INVENTION

Problem to be Solved by the Invention

However, with the disclosed techniques of Patent Literatures 1-3 described above, the static bending strength cannot be satisfactorily improved. Furthermore, since the method for improving the static bending strength is made generally by increasing the hardness of the base material or adding the large amount of alloying elements, the techniques are not desirable method in terms of machinability before carburization. Therefore, both excellent machinability before carburization and excellent static bending strength have been desired.

In order to solve the problem as described above, an object of the present invention is to provide a carburized steel part having excellent machinability before carburization and excellent static bending strength as compared with related techniques.

Means for Solving the Problem

To solve the problem described above, the present invention employs the following configurations.

(1) A first aspect of the present invention provides a carburized steel part obtained by subjecting a base material to a cutting operation and a carburizing operation, in which the base material includes chemical components of C: greater than 0.3 but less than or equal to 0.6% by mass; Si: 0.01 to 1.5% by mass; Mn: 0.3 to 2.0% by mass; P: 0.0001 to 0.02% by mass; S: 0.001 to 0.15% by mass; N: 0.001 to 0.03% by mass; Al: greater than 0.06 but less than or equal to 0.3% by mass; and, O: 0.0001 to 0.005% by mass, with a balance including iron and inevitable impurities, and in which the carburized steel part has a hardness of HV550 to HV800 in a surface layer portion, and a hardness of HV400 to HV550 in a core portion.

(2) In the carburized steel part according to item (1) above, the base material may further include one or more chemical components of: Ca: 0.0002 to 0.005% by mass, Zr: 0.0003 to 0.005% by mass, Mg: 0.0003 to 0.005% by mass, and Rem: 0.0001 to 0.015% by mass.

(3) In the carburized steel part according to item (1) or (2) above, the base material may further include a chemical component of B: 0.0002 to 0.005% by mass.

(4) In the carburized steel part according to any one of items (1)-(3) above, the base material may further include one or more chemical components of Cr: 0.1 to 3.0% by mass, Mo: 0.1 to 1.5% by mass, Cu: 0.1 to 2.0% by mass, and, Ni: 0.1 to 5.0% by mass.

(5) In the carburized steel part according to any one of items (1)-(4) above, the base material may further include one or more chemical components of Ti: 0.005 to 0.2% by mass, Nb: 0.01 to 0.1% by mass, and, V: 0.03 to 0.2% by mass.

(6) It may be possible that the carburized steel part according to any one of items (1)-(5) above is a gear.

Effects of the Invention

According to a configuration described in the item (1) above, a carburized steel part having both excellent machinability before carburization and excellent static bending strength can be obtained.

According to a configuration described in the item (2) above, an effect of improving machinability before carburization or an anisotropy reduction effect for the mechanical properties resulting from MnS can be obtained.

According to a configuration described in the item (3) above, an effect of increasing the static bending strength due to an improvement in the hardenability or grain boundary strength can be obtained.

According to a configuration described in the item (4) above, an effect of increasing the static bending strength through an increase in the hardenability can be obtained.

According to a configuration described in the item (5) above, an effect of preventing coarsening of the grains can be obtained.

According to a configuration described in the item (6) above, a gear having both excellent machinability before carburization and excellent static bending strength can be obtained.

Additionally, according to the present invention, it is possible to realize a significant miniaturization and weight-reduction of the gear, without causing a large increase in the production cost due to deterioration in the machinability before carburization of the carburized steel part, and it is also possible to improve the fuel efficiency of an automobile and achieve the resulting reduction in the amount of $CO_2$ emission.

To solve the problem described above, the present inventors earnestly studied machinability before carburization and static bending strength properties by changing chemical components and carburized material properties of steel in an extensive and systematic manner, and found the following points.

(1) To improve the static bending strength, it is found that it was appropriate for the hardness of a surface layer portion of a carburized steel part (hardness in a region from a surface layer up to 50 μm depth), to be in a range of HV 550 to HV 800. Additionally, the resulting effect increases as the value within the range becomes lower.

(2) To improve the static bending strength, it was found that it is appropriate for the hardness of a core portion of the carburized steel part (hardness in a region where a C content increases by 10% or less from that of a base material), to be in a range of HV 400 to HV 550. Furthermore, it was also found that the resulting effect increases as the value within the range becomes higher, and it is appropriate to increase the C content within a range up to 0.6% by mass to improve the static bending strength.

Figure 6:
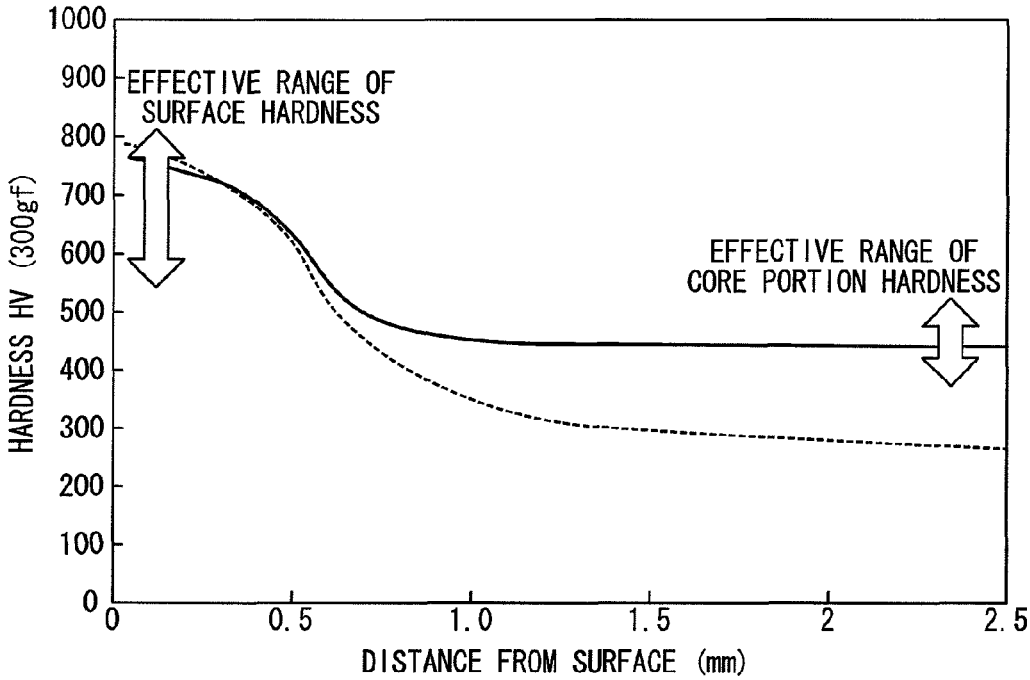
FIG. 6 is a diagram showing, in a solid line, a distribution of the hardness in a carburized steel according to the present invention; and, FIG. 7 is a diagram showing a distribution of the hardness in a carburized steel according to the related technique.
Figure 7:
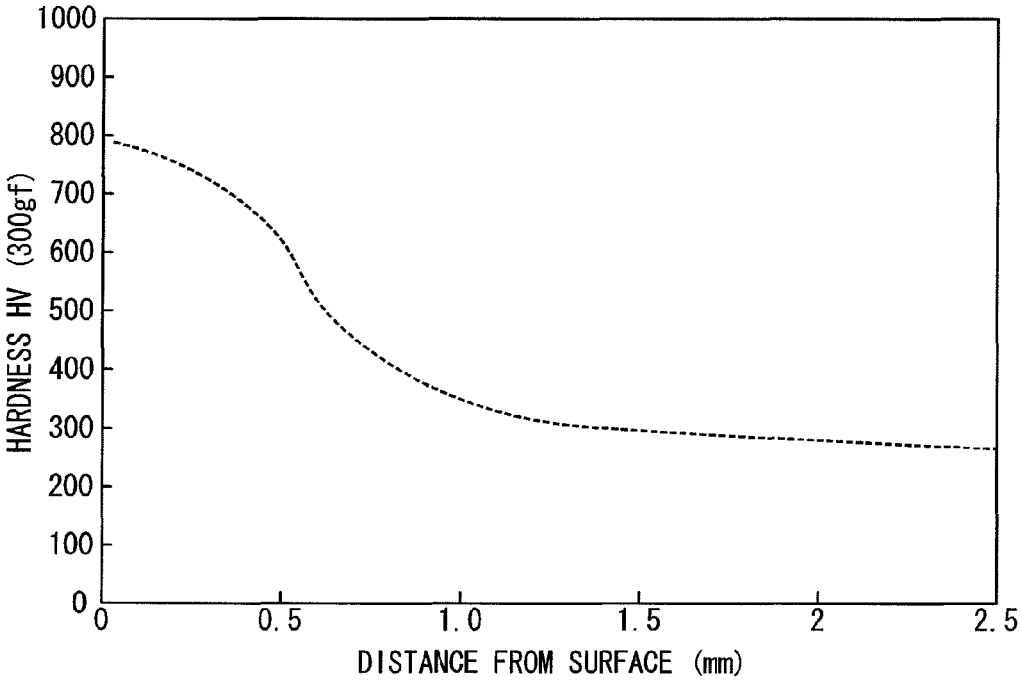

In other words, as shown in FIG. 6, which represents, in a solid line, a relationship between the Vickers hardness and a depth from the surface of the carburized steel part according to the present invention, it was found that it is appropriate for the hardness of the surface layer portion to be in a range of HV 550 to HV 800, while the hardness of the core portion is in a range of HV 400 to HV 550. Note that the broken line in FIG. 6 indicates a distribution of hardness in the conventional carburized steel material.

(3) In the past, it has been said that, when the C content exceeds 0.3%, the toughness of the carburized steel part decreases, and hence, cracks are likely to appear. This causes the static bending strength to decline. However, the present inventors found that the primary cause of the decrease in toughness is due to the hardness of the core portion exceeding HV 550, rather than the C content. Additionally, the present inventors found that, to avoid the hardness of the core portion exceeding HV 550 due to the fact that the base material contains C exceeding 0.6%, it is necessary to set an upper limit of C at 0.6%.

(4) To improve the static bending strength, it was found that it is effective to increase Si within a range of 0.01% to 1.5%. In the past, since Si decreases the strength due to formation of an intergranular oxide layer during the carburization, it has been recommended that Si be limited to 0.5% or less. However, the present inventors found that the effect of the intergranular oxide layer on the static bending strength is extremely small, and rather, it is effective to lower the hardness of the surface layer portion and increase the hardness of the core portion by increasing Si to improve the static bending strength.

(5) It was found that, by making the value of P as small as possible and adding B, the effects of (1)-(3) described above further improve.

(6) It was found that, when the amount of Al contained in the base material exceeds 0.06%, solute Al formed in the base material can improve the machinability before carburization of the base material. In particular, it was found that, when a cutting operation is implemented by using a tool coated with a coating containing the oxide formed by metal elements having an affinity with oxygen less than or equal to that of Al, that is, an oxide having an absolute value of standard free-energy of formation less than or equal to that of $Al_2O_3$, a chemical reaction is likely to occur at a contact surface of the tool with the steel; this makes the formation of the $Al_2O_3$ coating on the tool surface layer easy; and this coating functions as the tool protection coating, whereby the service life of the tool can be significantly prolonged.

With reference to the drawings, a mode for carrying out the present invention based on the above findings will be described below.

A carburized steel part according to an embodiment of the present invention is manufactured by applying a cutting operation and a carburizing operation to a base material containing C, Si, Mn, P, S, N, Al, and O. Hereinbelow, the preferable content of each of the chemical components will be described. Note that the character "%" concerning the content of each chemical component represents a % by mass.

(C: Greater than 0.3% but Less Than or Equal to 0.6%)

C adds hardness to the core portion of a part having been subjected to the carburizing and hardening operation, and contributes to improving the static bending fatigue strength. A main structure of the core portion of the part having been subjected to the carburizing and hardening operation is martensite. Further, with the increase in the C content, the hardness of the martensite after the carburizing and hardening operation increases. Additionally, even if the core portion has the same degree of hardness, the yielding point ratio increases due to dispersion strengthening of fine carbide particles, as the C content increases. To reliably obtain this effect, it is necessary to set the C content over 0.3%. Further, it is preferable to set the C content at 0.32% or more, or at 0.35% or more to make the core portion have the hardness of HV 450 or more in order to improve the static bending fatigue strength. On the other hand, when the C content exceeds 0.6%, the hardness of the core portion exceeds HV 550 as described above, which causes the rapid drop in the machinability before carburization. Therefore, it is necessary to set the C content to greater than 0.3% but less than or equal to 0.6%. In terms of machinability before carburization, since it is preferable that the C content be 0.40% or lower, the preferable range of C is 0.32 to 0.40%.

(Si: 0.01 to 1.5%)

Si is an effective element in deoxidizing the steel, and an effective element in improving a resistance to temper softening. Further, Si adds the hardness to the core portion of the part having been subjected to the carburizing and hardening operation through the improvement in hardenability, which contributes to improving the low-cycle bending fatigue strength. When Si is less than 0.01%, Si cannot provide sufficient effect described above, and when Si exceeds 1.5%, carburizing properties are inhibited. Therefore, it is necessary for the amount of Si to be in a range of 0.01 to 1.5%. When a general gas carburizing method with a carbon potential of 0.7-1.0 is employed, Si in a range of 0.5 to 1.5% has an effect of suppressing the hardness of a surface layer portion due to the effect of Si for increasing the activity of C in the steel, which is effective in further improving the static bending strength. The preferable range of Si is 0.5-1.5%.

(Mn: 0.3 to 2.0%)

Mn is an effective element in deoxidizing the steel, and adds the hardness to the core portion of the part having been subjected to the carburizing and hardening operation through the improvement in hardenability, which contributes to improving the static bending strength. When Mn is Less than 0.3%, its Effect is Insufficient, and when Mn exceeds 2.0%, the effect described above becomes saturated. Therefore, it is necessary for the amount of Mn to be in a range of 0.3 to 2.0%.

(P: 0.0001% to 0.02%)

P is Segregated in Austenite Grain Boundaries at the Time of Carburizing, which causes an intergranular fracture to lower the static bending strength. Therefore, it is necessary to limit its content to 0.02% or lower. The preferable range is 0.01% or lower. On the other hand, from the viewpoint of cost, it is not preferable that the P content be lower than 0.0001%. Accordingly, the preferable range of P is 0.0001% or more, but lower than or equal to 0.01%. The character "A" in FIG. 2 and the character "A" in FIG. 3 indicate examples in which the static bending strength is lowered due to the excessive addition of P.

(S: 0.001 to 0.15%)

S is Added for the Purpose of Improving the Machinability Before Carburization resulting from MnS formed in the steel. When S is lower than 0.001%, its effect is insufficient. On the other hand, when S exceeds 0.15%, its effect becomes saturated, and intergranular segregation occurs, which causes intergranular embrittlement. Because of the reasons described above, it is necessary for the S content to be in a range of 0.001 to 0.15%. The preferable range is 0.01 to 0.1%.

(N: 0.001 to 0.03%)

N Combines with al, Ti, Nb, V and the Like in the Steel, and Generates Nitride or carbonitride to suppress coarsening of crystal grains. When N is less than 0.001%, its effect is insufficient. On the other hand, when N exceeds 0.03%, its effect becomes saturated, and non-solute carbonitride remains and exists at the time of hot rolling and hot forging heat, which makes it difficult to increase the amount of fine carbonitride that is effective in suppressing the coarsening of the crystal grains. Therefore, it is necessary for the N content to be in a range of 0.001 to 0.03%. The preferable range is 0.003 to 0.010%.

(Al: Greater than 0.06 but Less than or Equal to 0.3%)

Figure 5:
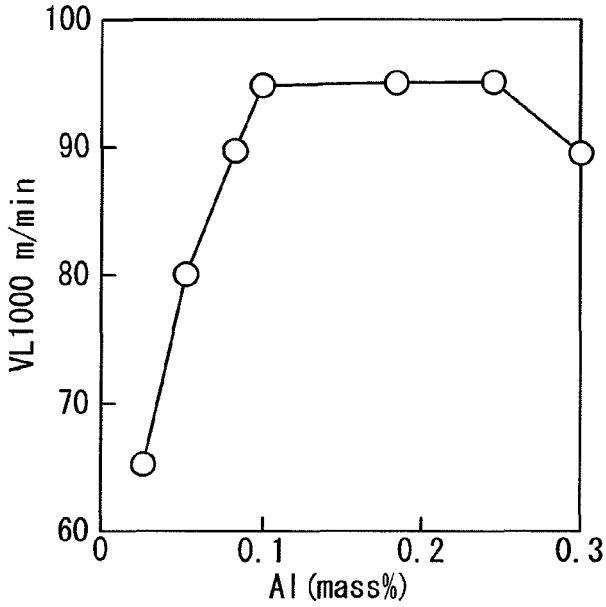
FIG. 5 is a diagram showing a relationship between Al content and machinability before carburization.

FIG. 5 is a diagram showing the machinability before carburization of eight types of base material containing N which is limited to 0.008% or lower, and Al of 0.02%, 0.04%, 0.08%, 0.1%, 0.18%, 0.24% or 0.3%. As shown in FIG. 5, it can be understood that, with the increase in the Al content, the machinability before carburization is further improved. This effect of improving the machinability before carburization is based on the effect of a protective coat resulting from $Al_2O_3$ formed on the tool surface by a chemical reaction of the solute Al existing in the base material with an oxide layer ($Fe_3O_4$) of a surface layer portion of the cutting tool. On the other hand, when the Al increases excessively, the size of $Al_2O_3$ inclusion becomes large, which has a negative effect on the high-cycle fatigue strength. Therefore, it is necessary to set the Al content in a range of over 0.06 to 0.3%. The preferable range is 0.075% to 0.25%. The further preferable range is 0.1 to 0.15%.

(O: 0.0001% to 0.005%)

O is an element that causes intergranular segregation, which is likely to cause intergranular embrittlement, and that forms hard oxide-based inclusions (for example, $Al_2O_3$) in steel, which is likely to cause brittle fracturing. It is necessary to limit the O to 0.005% or lower. On the other hand, in terms of cost, it is not preferable to set the O content to lower than 0.0001%. Therefore, the preferable range of O is 0.0001% to 0.005%.

Further, it may be possible that the base material described above contains one or more elements of Ca, Zr, Mg and Rem. In this case, an improvement effect for machinability before carburization or an anisotropy reduction effect for the mechanical properties resulting from MnS can be obtained. Hereinafter, desirable contents in a case of containing these chemical components will be described.

(Ca: 0.0002 to 0.005%)

Ca lowers a melting point of oxide, and softens the base material due to the temperature increase under the cutting operation environment, whereby the machinability before carburization improves. However, when Ca is less than 0.0002%, it does not have any effect, and when Ca exceeds 0.005%, a large amount of CaS is generated, which lowers the machinability before carburization. Therefore, it is desirable to set the amount of Ca in a range of 0.0002 to 0.005%.

(Zr: 0.0003 to 0.005%)

Zr is a deoxidation element and generates oxide, and Zr also generates sulfide and thus is an element that has a correlation with MnS. Zr-based oxide is likely to form a nucleus of crystallization/precipitation of MnS, thereby being effective in controlling the dispersion of MnS. As for the amount of Zr added, it is preferable to add Zr exceeding 0.003% to spheroidize the MnS. On the other hand, to finely disperse the MnS, it is preferable to add Zr of 0.0003 to 0.005%. In terms of product, the latter is preferable, and in terms of manufacturing and quality stability (components yields, etc.), the latter, that is, 0.0003 to 0.005% in which MnS is finely dispersed is realistically preferable. When Zr is 0.0002% or lower, almost no effect of adding Zr can be seen.

(Mg: 0.0003 to 0.005%)

Mg is a deoxidation element and generates oxide, and Mg also generates sulfide and thus is an element that has a correlation with MnS. Mg-based oxide is likely to form a nucleus of crystallization/precipitation of MnS. Further, the sulfide becomes composite sulfide with Mn and Mg, thereby suppressing its deformation and spheroidizing it. Therefore, Mg is effective in controlling the dispersion of MnS. However, when Mg is less than 0.0003%, no effect is obtained, and when Mg exceeds 0.005%, a large amount of MgS is generated, which lowers the machinability before carburization. Therefore, it is preferable for the amount of Mg to be in a range of 0.0003 to 0.005%.

(Rem: 0.0001 to 0.015%)

Rem (rare-earth element) is a deoxidation element and generates low-melting-point oxide. Rem not only suppresses a clogging of a nozzle at the time of forging, but is also solid-solved in or combined with MnS, thereby lowering its deformability. Also, Rem functions so as to suppress the extension of the shape of MnS at the time of the rolling and the hot forging. As described above, Rem is an effective element in lowering the anisotropy. However, when the total Rem content is less than 0.0001%, its effect is not significant, and when the added Rem exceeds 0.015%, the large amount of sulfide with Rem is generated, which deteriorates the machinability before carburization. Therefore, in a case of adding Rem, its content is in a range of 0.0001 to 0.015%.

Further, it may be possible that the base material described above contains B to improve the static bending strength due to the improvement in the hardenability or grain boundary strength. A preferable content in a case of containing B will be described below.

(B: 0.0002 to 0.005%)

B Suppresses the Intergranular Segregation of P, and Contributes to Increasing the static bending strength through the increase in the grain boundary strength and the strength in the grain thereof, and the improvement in the hardenability. When B is less than 0.0002%, its effect is insufficient, and when B exceeds 0.005%, its effect becomes saturated. Therefore, it is desirable to set its content in a range of 0.0002 to 0.005%. The preferable range is 0.0005 to 0.003%.

Further, it may be possible that the base material described above contains one or more elements of Cr, Mo, Cu, and Ni to improve the static bending strength resulting from the improvement in the hardenability. A desirable content in a case of containing these chemical components will be described below.

(Cr: 0.1 to 3.0%)

Cr adds the hardness to the core portion of the part having been subjected to the carburizing and hardening operation through the improvement in hardenability, and is an effective element in improving the static bending strength. When Mn is less than 0.1%, its effect is insufficient, and when Mn exceeds 3.0%, its effect becomes saturated. Therefore, it is desirable for the amount of Cr to be in a range of 0.1 to 3.0%.

(Mo: 0.1 to 1.5%)

Mo adds the hardness to the core portion of the part having been subjected to the carburizing and hardening operation through improvement in hardenability, and is an effective element in improving the static bending strength. When Mn is less than 0.1%, its effect is insufficient, and when Mn exceeds 1.5%, its effect becomes saturated. Therefore, it is desirable for the amount of Mo to be in a range of 0.1 to 1.5%.

(Cu: 0.1 to 2.0%)

Cu adds the hardness to the core portion of the part having been subjected to the carburizing and hardening operation through the improvement in hardenability, and is an effective element in improving the static bending strength. When Cu is less than 0.1%, its effect is insufficient, and when Cu exceeds 2.0%, its effect becomes saturated. Therefore, it is desirable for the amount of Cu to be in a range of 0.1 to 2.0%.

(Ni: 0.1 to 5.0%)

Ni adds the hardness to the core portion of the part having been subjected to the carburizing and hardening operation through the improvement in hardenability, and is an effective element in improving the static bending strength. When Ni is Less than 0.1%, its effect is insufficient, and when Ni exceeds 5.0%, its effect becomes saturated. Therefore, it is desirable for the amount of Ni to be in a range of 0.1 to 5.0%.

Further, it may be possible that the base material described above contains one or more elements of Ti, Nb, and V to prevent the grains from coarsening at the time of making the carburization temperature higher or carburization time longer so as to increase the depth of carburizing, that is, to arrange and refine the austenite grain by increasing the amount of the carbonitride. A preferable content in a case of containing these chemical components will be described below.

(Ti: 0.005 to 0.2%)

When Ti is added, fine TiC and TiCS are generated in the steel. For this reason, Ti may be added to refine the austenite grain at the time of carburizing Further, in a case of adding Ti, Ti combines with N in the steel to generate TiN, whereby a precipitation-prevention effect of BN can be obtained. In other words, solute B can be obtained. When Ti is less than 0.005%, its effect is insufficient. On the other hand, when Ti exceeds 0.2%, the amount of precipitates formed mainly by TiN becomes increased, which leads to deterioration in a rolling contact fatigue property. For the reasons described above, it is desirable for the Ti content to be in a range of 0.005 to 0.2%. The preferable range is 0.01 to 0.1%.

(Nb: 0.01 to 0.1%)

By adding Nb, carbonitride of Nb is generated, and the coarsening of crystal grains are suppressed. When Nb is less than 0.01%, its effect is insufficient. On the other hand, when Nb exceeds 0.1%, the machinability before carburization deteriorates, and hence, the upper limit is set to 0.1%.

(V: 0.03 to 0.2%)

By Adding V, Carbonitride of V is Generated, and the Coarsening of Crystal grains are suppressed. When V is less than 0.03%, its effect is insufficient. On the other hand, when V exceeds 0.2%, the machinability before carburization deteriorates. Hence, the upper limit is set to 0.05%.

It should be noted that, in addition to the elements described above, the base material according to the present invention may contain impurities inevitably incorporated thereinto during the manufacturing process, but it is preferable to keep such impurities as minimal as possible.

Next, a description will be made of the hardness of the surface layer portion and the hardness of the core portion of the carburized steel part obtained by applying the carburizing operation to the above-described base material, according to the embodiment of the present invention.

(Hardness of Surface Layer Portion HV 550 to HV 800)

Figure 2:
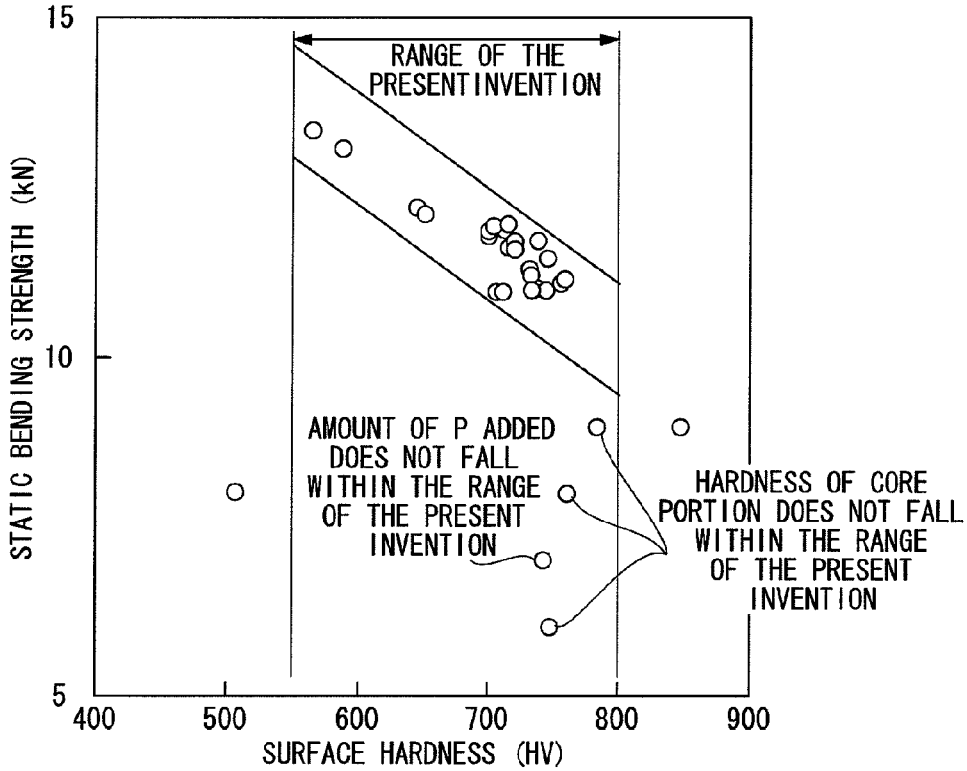
FIG. 2 is a diagram showing an effect of a hardness of a surface layer portion on a static bending strength.

As shown in FIG. 2, the present inventors found that, when the hardness of the surface layer portion is in a range of HV 550 to HV 800, the static bending strength increasingly improves as the hardness of the surface layer portion decreases. Further, based on the results of fracture surface observation on fractured products, the present inventors found that this is because, when the hardness of the surface layer portion is high, a crack of brittle fracture surface appears from the surface, and the brittle fracture surface rapidly propagates. This tendency becomes remarkable if the hardness exceeds HV 800. For this reason, it is preferable that the hardness of the surface layer portion be HV 800 or lower, and more preferably, the hardness is HV 770 or lower. When the hardness of the surface layer portion is low, although the crack similarly appears from the surface, the rate of occurrence of the brittle fracture surface is low, and thus the crack propagation speed is slow, whereby the static bending strength is improved. However, when the hardness of the surface layer portion is less than HV 550, the amount of plastic deformation at the outermost surface layer significantly increases (corresponding to a large deformation of a tooth surface in a case of gear), which impairs the gear function. Additionally, the decrease in the hardness of the outermost surface layer leads to the deterioration in the high-cycle bending fatigue strength and the wear resistance. For the reasons above, it is necessary to set the hardness of the surface layer portion in a range of HV 550 to HV 800. Since the hardness of the surface layer portion corresponds to the hardness of the carburized layer, the hardness can be adjusted by adjusting the carbon potential at the time of carburizing or adjusting the tempering temperature after the carburizing and hardening operation. As a guide for adjusting, the steel part is subjected to the carburizing and hardening operation at the carbon potential of 0.8, and then is subjected to the tempering at a temperature of 150° C., and thereafter, the static bending test is implemented. As a result of the test, if the static bending strength is lower than a predetermined strength, adjustment is made such that the carbon potential is lowered to 0.7, or the tempering temperature is raised to 180° C. to lower the hardness of the surface layer portion, and the static bending strength is improved.

(Hardness of Core Portion HV 400 to HV 550)

Figure 3:
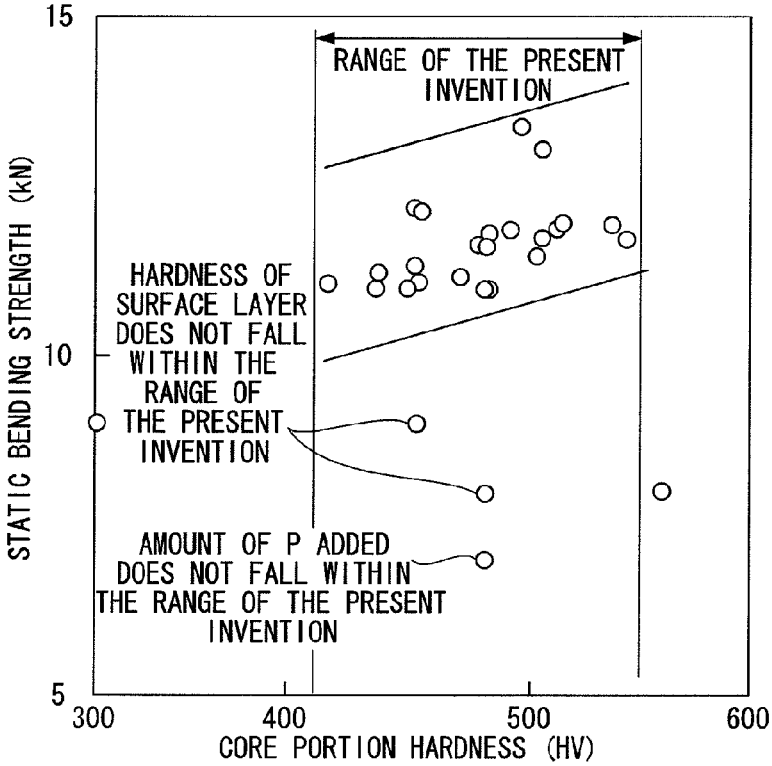
FIG. 3 is a diagram showing an effect of a hardness of a core portion on a static bending strength.
Figure 4:
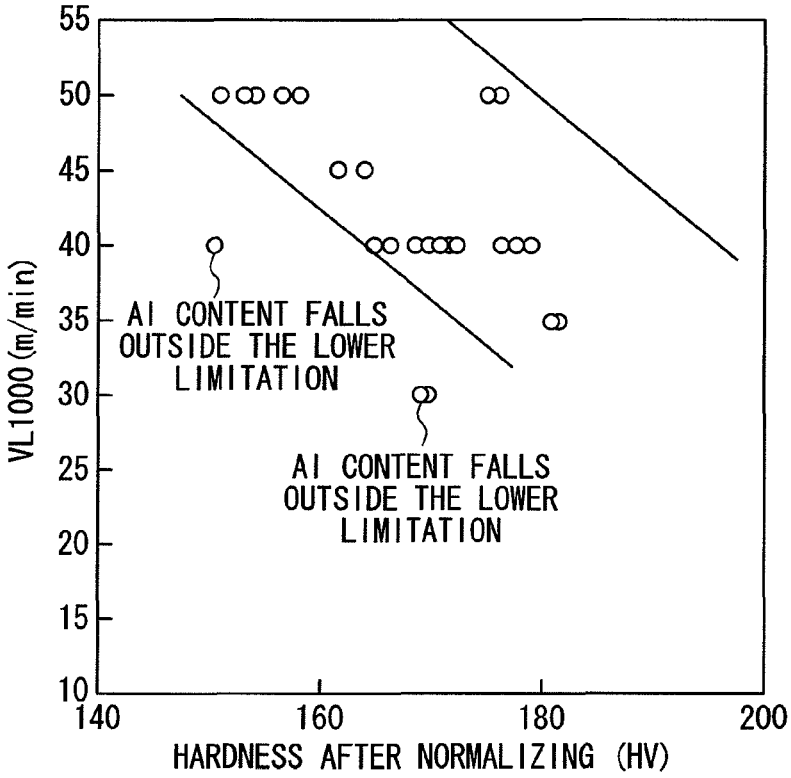
FIG. 4 is a diagram showing the effect of Al content on machinability before carburization.

As shown in FIG. 3, the present inventors found that, when the hardness of the core portion is in a range of HV 400 to HV 550, the static bending strength increasingly improves as the hardness of the core portion increases. As a result of fracture surface observation and so on, the present inventors found that this is because, if the hardness of the core portion is low, the core portion immediately below the carburized layer yields and cannot bear a further stress, and the stress occurring at the surface of the steel part, which is the carburized layer, becomes larger. In the past, to improve the static bending strength more significantly than generally-used JIS-SCr 420, JIS-SCM 420 and the like, the hardness of HV 400 or more is required. Therefore, it is necessary for the hardness of the core portion to be in a range of HV 400 to HV 550. Desirably, the hardness of the core portion is in a range of HV 430 to HV 550. More desirably, the hardness of core portion is in a range of HV 450 to HV 550. Note that, when the hardness of the core portion exceeds HV 550, the toughness of the core portion significantly decreases, and the static bending strength decreases through the increase in the crack propagation speed in the core portion.

It should be noted that B1, B2 and B3 in FIG. 2 indicate the static bending strength of the carburized steel part whose core portion hardness does not fall within the range stated above, and B1', B2' and B3' in FIG. 3 indicate the static bending strength of the carburized steel part whose surface layer portion hardness does not fall within the range stated above. From FIGS. 2 and 3 that indicate those points, it can be understood that, if one of the surface layer portion hardness and the core portion hardness falls outside the range stated above, the sufficient static bending strength cannot be obtained. Therefore, the hardness of the surface layer portion of the carburized steel part according to this embodiment is in the range of HV550 to HV800, and the hardness of the core portion is in the range of HV400 to HV550.

It should be noted that the term "core portion" as used herein represents a portion where the amount of C infiltrating from a surface of the part through the carburizing operation decreases as the depth becomes greater. More specifically, the core portion represents a portion where C content increases by 10% or lower from that of the base material (when C content of the base material is 0.20%, the value is 0.22%). The term "base material" as used herein means steel before the carburizing operation. Therefore, the core portion can be identified by C-line analysis of EPMA and so on. Adjustment of the hardness of the core portion is made by adjusting the C concentration of the base material or the hardenability through the addition of alloying elements.

It should be noted that a special method is not necessary for the carburizing method, and an effect of the present invention may be obtained through any general carburizing method such as gas carburizing, low pressure carburizing, or gas carbonitriding.

The carburized steel part according to the present invention is used for machine construction parts, and differential gears, transmission gears, carburized toothed shafts or other gear parts, and, especially, is useful for the differential gears.

EXAMPLE

Hereinbelow, the present invention will be specifically described through an example. Note that the example below is given for the purpose of explaining the present invention, and is not given for limiting the scope of the present invention.

Figure 1:
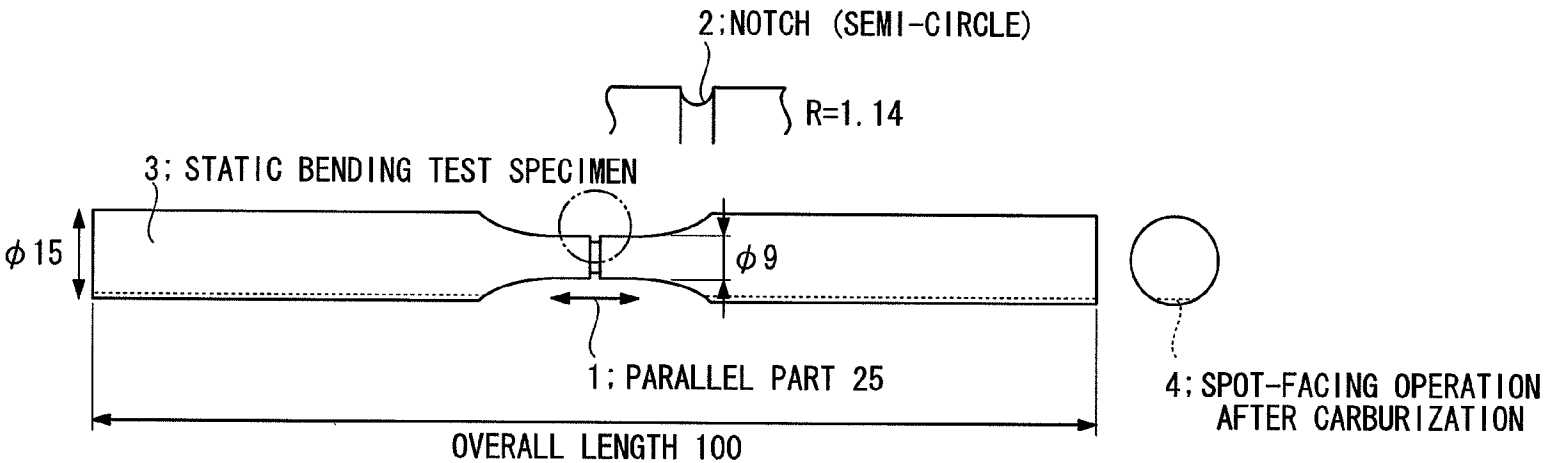
FIG. 1 is a schematic diagram showing a specimen for a static bending test.

After steel ingots having chemical components shown in Table 1 were extended and forged to be 35 mm diameter and then were subjected to soaking and normalizing (provided that the steel is formed to be a ferrite-pearlite structure by controlled cooling), the steel was subjected to a machining for obtaining a specimen for a drill-cutting operation, and a rough machining for obtaining a static bending test specimen (15 mm diameter) 3 having a parallel part 1 and a notch (semicircle) 2 at a center recessed portion as shown in FIG. 1 (except for a spot-facing operation).

As for the specimen for a drill-cutting operation, a cylindrical specimen having a diameter of 30 mm and a height of 21 mm was cut out, and subjected to a milling finish to obtain the specimen for the drill-cutting operation.

Next, regarding the specimens for the static bending test having been subjected to the rough machining, specimens No. 1-29, and 31 were subjected to the carburizing operation at 930° C. for five hours in a transformation-type gas carburizing furnace, and then subjected to oil hardening at 130° C. Specimen No. 30 was subjected to the carburizing operation at 930° C. for five hours, and then subjected to the oil hardening at 220° C. After being subjected to the oil hardening, the specimens No. 1-30 were then subjected to tempering at 150° C. for 1.5 hours. On the other hand, after being subjected to the oil hardening, the specimen No. 31 was then subjected to the tempering at 120° C. for 1.5 hours. Note that adjustment was made such that the carbon potential at the time of the carburizing operation was set in a range of 0.5-0.8, and the tempering temperature was set in a range of 150-300° C., except for the specimen No. 31, to adjust the surface layer portion hardness and the core portion hardness. After this, the specimens were subjected to the spot-facing operation 4 of 1 mm to manufacture the specimens for the static bending test. Note that the specimen for the static bending test after rough machining was shaped such that a broken-lined portion was removed from FIG. 1, and the specimen for the static bending test after the finishing operation was shaped such that the spot-facing operation corresponding to the broken-lined portion in FIG. 1 was applied to the specimen for the static bending test after rough machining.

Table 2 shows the examination results concerning the hardness after normalizing and the material properties after a carburizing operation (after carburizing, hardening, and tempering operations) as described above.

Regarding a test on the machinability before carburization, a drill-boring test was conducted to a specimen for a drill-cutting operation under a cutting condition shown in Table 3, and evaluation was made on the machinability before carburization of each steel material in this example and comparative examples. In this test, as an evaluation parameter, a maximum cutting rate VL1000 (m/min) at which a 1000-mm-depth cumulative hole could be bored was employed in the drill-boring test.

In the static bending test, a specimen for the static bending test was bent at four points. This test was conducted at a compression rate of 0.1 mm/min to obtain the maximum load up to the break point, which is defined as the static bending strength. However, when the hardness of the surface layer portion was exceptionally low, the amount of plastic deformation at the outermost surface layer was significantly increased, and hence, the maximum load up to this point was defined as the static bending strength. Table 2 shows the results of the static bending strength.

As shown in Table 2, it was found that the specimens No. 1-23 of the example according to the present invention not only had excellent static bending strength of 11 kN or more, but also had excellent machinability (VL1000) before carburization of 35 m/min or more.

On the other hand, the specimen No. 24 of the comparative example had the poor static bending strength. This is because C in the steel material is lower than 0.3%, which is the range specified in the present invention, and as a result, the hardness of the core portion thereof becomes lower than the range specified in the present invention.

The specimen No. 25 of the comparative example had the poor static bending strength. This is because C in the steel material exceeds 0.6%, which is the range specified in the present invention, and as a result, the hardness of the core portion thereof becomes higher than the range specified in the present invention.

The specimen No. 26 of the comparative example had the poor static bending strength. This is because the carburization property is inhibited due to the fact that Si in the steel material exceeds 1.5%, which is the range specified in the present invention. As a result, the hardness of the surface layer portion thereof becomes lower than that of the range specified in the present invention, and the amount of plastic deformation at the outermost surface layer is significantly increased. Hence, the evaluation is made by defining the maximum load up to this point as the static bending strength.

The specimen No. 27 of the comparative example had the poor static bending strength. This is because P in the steel material exceeds 0.02%, which is the range specified in the present invention, and as a result, an intergranular fracture is caused by the intergranular segregation of P.

The specimens No. 28 and 29 of the comparative example had poor machinability before carburization. This is because Al in the steel material is lower than the range of greater than 0.06%, which is the range specified in the present invention, and as a result, the effect of improving the machinability before carburization obtained by the solid solution Al cannot be obtained.

The specimen No. 30 of the comparative example had poor static bending strength. This is because the oil temperature for hardening is high, which is 220° C. As a result, the hardening is not sufficient, resulting in the hardness of the core portion thereof being lower than HV400, which is the range specified in the present invention.

The specimen No. 31 of the comparative example had poor static bending strength. This is because the tempering temperature is low, which is 120° C., and as a result, the hardness of the surface layer portion exceeds HV800 specified in the present invention.

[Table 1]

[Table 2]

TABLE 3

| Cutting condition | Drill | Others |
|---|---|---|
| Cutting rate: 1-100 m/min | Diameter of drill: 3 mm diameter | Depth of hole: 9 mm |
| Feed: 0.25 mm/rev | NACHI Normal drill | Tool life: Until tool is broken |
| Oil material for cutting: Water-soluble cutting oil | Protrusion length: 45 mm | |

(NACHI Normal drill refers to a drill whose type is SD 3.0 made by NACHI-FUJIKOSHI CORP. - The outermost surface layer of this tool is iron-based oxide)

INDUSTRIAL APPLICABILITY

According to the present invention, a carburized steel part having static bending strength and machinability before carburization more excellent than the conventional one can be manufactured. Therefore, sufficient industrial applicability exists.

BRIEF DESCRIPTION OF THE REFERENCE SYMBOLS

1 parallel part

2 notch (semi-circle)

3 static bending test specimen

4 spot-facing operation after carburization

| Brief Description of the Reference Symbols | |
|---|---|
| 1 | parallel part |
| 2 | notch (semi-circle) |
| 3 | static bending test specimen |
| 4 | spot-facing operation after carburization |

TABLE 1

| Test No. | Category | Chemical compoenent (percentage by mass) C | Si | Mn | P | S | N | Al | O | B |
|---|---|---|---|---|---|---|---|---|---|---|
| 1 | Invention Example | 0.34 | 0.25 | 0.81 | 0.010 | 0.015 | 0.010 | 0.080 | 0.0010 | — |
| 2 | Invention Example | 0.40 | 0.99 | 0.81 | 0.009 | 0.015 | 0.080 | 0.105 | 0.0009 | 0.0016 |
| 3 | Invention Example | 0.31 | 0.91 | 0.80 | 0.010 | 0.015 | 0.012 | 0.064 | 0.0012 | 0.0010 |
| 4 | Invention Example | 0.41 | 0.90 | 0.80 | 0.009 | 0.149 | 0.011 | 0.099 | 0.0009 | 0.0019 |
| 5 | Invention Example | 0.40 | 0.92 | 0.79 | 0.008 | 0.100 | 0.011 | 0.101 | 0.0009 | 0.0015 |
| 6 | Invention Example | 0.35 | 1.03 | 0.81 | 0.009 | 0.015 | 0.011 | 0.061 | 0.0010 | — |
| 7 | Invention Example | 0.40 | 0.99 | 0.79 | 0.010 | 0.016 | 0.012 | 0.298 | 0.0019 | — |
| 8 | Invention Example | 0.38 | 0.79 | 0.80 | 0.010 | 0.014 | 0.011 | 0.149 | 0.0010 | — |
| 9 | Invention Example | 0.34 | 1.41 | 0.81 | 0.011 | 0.015 | 0.005 | 0.145 | 0.0009 | 0.0029 |
| 10 | Invention Example | 0.31 | 0.25 | 0.74 | 0.009 | 0.015 | 0.005 | 0.150 | 0.0049 | 0.0011 |
| 11 | Invention Example | 0.35 | 1.01 | 0.80 | 0.010 | 0.020 | 0.029 | 0.105 | 0.0009 | 0.0016 |
| 12 | Invention Example | 0.51 | 0.52 | 0.79 | 0.010 | 0.014 | 0.017 | 0.085 | 0.0008 | 0.0050 |
| 13 | Invention Example | 0.35 | 1.10 | 0.80 | 0.009 | 0.014 | 0.005 | 0.131 | 0.0010 | 0.0015 |
| 14 | Invention Example | 0.60 | 0.24 | 0.73 | 0.008 | 0.014 | 0.006 | 0.110 | 0.0006 | — |
| 15 | Invention Example | 0.33 | 1.02 | 0.30 | 0.010 | 0.016 | 0.004 | 0.082 | 0.0009 | 0.0021 |
| 16 | Invention Example | 0.36 | 0.61 | 2.00 | 0.009 | 0.015 | 0.012 | 0.090 | 0.0007 | — |
| 17 | Invention Example | 0.35 | 0.01 | 1.20 | 0.009 | 0.016 | 0.004 | 0.090 | 0.0010 | 0.0015 |
| 18 | Invention Example | 0.34 | 1.49 | 0.79 | 0.009 | 0.015 | 0.012 | 0.099 | 0.0011 | — |
| 19 | Invention Example | 0.39 | 1.20 | 0.79 | 0.020 | 0.015 | 0.005 | 0.102 | 0.0011 | 0.0012 |
| 20 | Invention Example | 0.32 | 1.11 | 0.79 | 0.010 | 0.015 | 0.001 | 0.110 | 0.0010 | — |
| 21 | Invention Example | 0.33 | 0.57 | 0.81 | 0.012 | 0.016 | 0.008 | 0.085 | 0.0008 | — |
| 22 | Invention Example | 0.31 | 0.52 | 1.89 | 0.012 | 0.014 | 0.014 | 0.085 | 0.0008 | — |
| 23 | Invention Example | 0.33 | 0.26 | 0.77 | 0.013 | 0.016 | 0.011 | 0.114 | 0.0011 | 0.0021 |
| 24 | Comparative Example | 0.29 | 0.26 | 0.73 | 0.020 | 0.016 | 0.015 | 0.031 | 0.0013 | — |
| 25 | Comparative Example | 0.61 | 1.01 | 0.81 | 0.009 | 0.015 | 0.014 | 0.080 | 0.0010 | — |
| 26 | Comparative Example | 0.35 | 1.56 | 0.81 | 0.009 | 0.015 | 0.005 | 0.085 | 0.0009 | 0.0015 |
| 27 | Comparative Example | 0.35 | 1.01 | 0.80 | 0.031 | 0.015 | 0.013 | 0.086 | 0.0011 | — |
| 28 | Comparative Example | 0.34 | 1.02 | 0.80 | 0.009 | 0.015 | 0.013 | 0.051 | 0.0011 | — |
| 29 | Comparative Example | 0.34 | 0.99 | 0.80 | 0.009 | 0.015 | 0.012 | 0.043 | 0.0011 | — |
| 30 | Comparative Example | 0.34 | 0.25 | 0.81 | 0.010 | 0.015 | 0.012 | 0.080 | 0.0010 | — |
| 31 | Comparative Example | 0.34 | 0.25 | 0.81 | 0.010 | 0.015 | 0.010 | 0.080 | 0.0010 | — |

| Test No. | Chemical compoenent (percentage by mass) Cr | Mo | Cu | Ni | Ti | Nb | V | Ca | Zr | Mg | Rem |
|---|---|---|---|---|---|---|---|---|---|---|---|
| 1 | 1.20 | — | — | — | — | — | — | — | — | — | — |
| 2 | 1.19 | — | — | — | — | 0.03 | — | — | — | — | — |
| 3 | 1.21 | — | — | — | — | — | — | — | — | — | — |
| 4 | 1.20 | — | — | — | — | — | — | — | — | — | — |
| 5 | 1.20 | — | — | — | — | — | — | — | — | — | — |
| 6 | 1.20 | — | — | — | — | — | — | — | — | — | — |
| 7 | 1.21 | — | — | — | — | — | — | — | — | — | — |
| 8 | — | — | — | 3.49 | — | — | — | — | — | — | — |
| 9 | — | — | — | — | 0.023 | 0.05 | — | — | 0.0006 | — | — |
| 10 | 1.20 | — | — | — | — | — | — | — | — | — | 0.0009 |
| 11 | 1.20 | — | — | — | 0.199 | — | — | — | — | — | — |
| 12 | 1.20 | — | — | — | 0.000 | — | — | — | — | — | — |
| 13 | 1.20 | — | — | — | 0.021 | — | 0.11 | 0.0005 | — | — | — |
| 14 | 0.00 | — | — | — | 0.000 | — | — | — | — | 0.0005 | — |
| 15 | 1.20 | 0.16 | — | — | 0.020 | 0.03 | — | — | — | — | — |
| 16 | 0.00 | — | 0.49 | — | — | — | — | — | — | — | — |
| 17 | 1.21 | — | — | — | 0.220 | 0.03 | — | — | — | — | — |
| 18 | 1.20 | — | — | — | — | — | — | — | — | — | — |
| 19 | 1.21 | — | — | — | — | — | — | — | — | — | — |
| 20 | 1.19 | — | — | — | — | 0.06 | — | — | — | — | — |
| 21 | — | — | — | — | — | — | — | 0.0006 | 0.0005 | — | — |
| 22 | — | — | — | — | — | — | — | — | — | — | — |
| 23 | — | — | — | — | — | — | — | — | — | — | — |
| 24 | 1.05 | — | — | — | — | — | — | — | — | — | — |
| 25 | 1.20 | — | — | — | — | — | — | — | — | — | — |
| 26 | 1.21 | — | — | — | 0.022 | 0.03 | — | — | — | — | — |
| 27 | 1.20 | — | — | — | — | — | — | — | — | — | — |
| 28 | 1.20 | — | — | — | — | — | — | — | — | — | — |
| 29 | 1.20 | — | 0.11 | — | — | — | — | — | — | — | — |
| 30 | 1.20 | — | — | — | — | — | — | — | — | — | — |
| 31 | 1.20 | — | — | — | — | — | — | — | — | — | — |

TABLE 2

| | | After carburization | | | After normalizing | |
|---|---|---|---|---|---|---|
| Test No. | Category | Surface harndness (HV) | Core portion hardness (HV) | Static bending strength (kN) | Hardness (HV) | VL1000 (m/min) |
| 1 | Invention Example | 756 | 449 | 11 | 158 | 50 |
| 2 | Invention Example | 747 | 503 | 11 | 176 | 40 |
| 3 | Invention Example | 737 | 406 | 11 | 165 | 40 |
| 4 | Invention Example | 714 | 513 | 12 | 176 | 50 |
| 5 | Invention Example | 713 | 514 | 12 | 175 | 50 |
| 6 | Invention Example | 759 | 467 | 11 | 171 | 40 |
| 7 | Invention Example | 721 | 505 | 12 | 176 | 40 |
| 8 | Invention Example | 645 | 447 | 12 | 156 | 50 |
| 9 | Invention Example | 565 | 496 | 13 | 161 | 45 |
| 10 | Invention Example | 732 | 447 | 11 | 154 | 50 |
| 11 | Invention Example | 703 | 481 | 12 | 171 | 40 |
| 12 | Invention Example | 715 | 538 | 12 | 181 | 35 |
| 13 | Invention Example | 701 | 490 | 12 | 172 | 40 |
| 14 | Invention Example | 740 | 544 | 12 | 170 | 40 |
| 15 | Invention Example | 715 | 475 | 12 | 166 | 40 |
| 16 | Invention Example | 705 | 515 | 12 | 178 | 40 |
| 17 | Invention Example | 720 | 480 | 12 | 164 | 45 |
| 18 | Invention Example | 654 | 450 | 12 | 177 | 40 |
| 19 | Invention Example | 590 | 506 | 13 | 179 | 40 |
| 20 | Invention Example | 735 | 430 | 11 | 168 | 40 |
| 21 | Invention Example | 708 | 429 | 11 | 151 | 50 |
| 22 | Invention Example | 712 | 443 | 11 | 153 | 50 |
| 23 | Invention Example | 736 | 428 | 11 | 166 | 40 |
| 24 | Comparative Example | 785 | 301 | 9 | 151 | 40 |
| 25 | Comparative Example | 763 | 560 | 8 | 206 | 30 |
| 26 | Comparative Example | 510 | 480 | 8 | 181 | 35 |
| 27 | Comparative Example | 745 | 480 | 7 | 171 | 40 |
| 28 | Comparative Example | 746 | 481 | 11 | 170 | 30 |
| 29 | Comparative Example | 745 | 480 | 11 | 169 | 30 |
| 30 | Comparative Example | 750 | 390 | 6 | 158 | 50 |
| 31 | Comparative Example | 849 | 448 | 9 | 158 | 50 |

The invention claimed is:

1. A carburized steel part obtained by subjecting a base material to a cutting operation and a carburizing operation, wherein the base material includes chemical components of:

C: 0.51 to 0.6% by mass;

Si: 0.01 to 1.5% by mass;

Mn: 0.3 to 2.0% by mass;

P: 0.0001 to 0.02% by mass;

S: 0.001 to 0.15% by mass;

N: 0.001 to 0.03% by mass;

Al: greater than 0.06 but less than or equal to 0.3% by mass; and,

O: 0.0001 to 0.005% by mass, with a balance including iron and inevitable impurities, and wherein the carburized steel part has a hardness of HV550 to HV800 in a surface layer portion, and a hardness of HV400 to HV550 in a core portion.

2. The carburized steel part according to claim 1, wherein the base material further includes one or more chemical components of:

Ca: 0.0002 to 0.005% by mass,

Zr: 0.0003 to 0.005% by mass,

Mg: 0.0003 to 0.005% by mass, and

Rem: 0.0001 to 0.015% by mass.

3. The carburized steel part according to claim 1, wherein the base material further includes a chemical component of B: 0.0002 to 0.005% by mass.

4. The carburized steel part according to claim 1, wherein the base material further includes one or more chemical components of:

Cr: 0.1 to 3.0% by mass,

Mo: 0.1 to 1.5% by mass,

Cu: 0.1 to 2.0% by mass, and,

Ni: 0.1 to 5.0% by mass.

5. The carburized steel part according to claim 1, wherein the base material further includes one or more chemical components of:

Ti: 0.005 to 0.2% by mass,

Nb: 0.01 to 0.1% by mass, and,

V: 0.03 to 0.2% by mass.

6. The carburized steel part according to any one of claims 1-5, wherein the carburized steel part is a gear.

7. The carburized steel part according to claim 1, wherein the base material further includes one or more chemical components of:

Ca: 0.0002 to 0.005% by mass,

Mg: 0.0003 to 0.005% by mass,

Rem: 0.0001 to 0.015% by mass,

Cu: 0.1 to 2.0% by mass, and

V: 0.03 to 0.2% by mass.

8. The carburized steel part according to claim 1, wherein the base material includes:

Al: 0.1 to 0.3% by mass.

9. A carburized steel part obtained by subjecting a base material to a cutting operation and a carburizing operation, wherein the base material consists of chemical components of:

C: 0.51 to 0.6% by mass;

Si: 0.01 to 1.5% by mass;

Mn: 0.3 to 2.0% by mass;

P: 0.0001 to 0.02% by mass;

S: 0.001 to 0.15% by mass;

N: 0.001 to 0.03% by mass;

Al: greater than 0.06 but less than or equal to 0.3% by mass; and,

O: 0.0001 to 0.005% by mass; and one or more chemical components of:

Ca: 0.0002 to 0.005% by mass;

Zr: 0.0003 to 0.005% by mass;

Mg: 0.0003 to 0.005% by mass;

Rem: 0.0001 to 0.015% by mass;

B: 0.0002 to 0.005% by mass;

Cr: 0.1 to 3.0% by mass;

Mo: 0.1 to 1.5% by mass;

Cu: 0.1 to 2.0% by mass;

Ni: 0.1 to 5.0% by mass;

Ti: 0.005 to 0.2% by mass;

Nb: 0.01 to 0.1% by mass; and

V: 0.03 to 0.2% by mass, with a balance consisting of iron and inevitable impurities, and wherein the carburized steel part has a hardness of HV550 to HV800 in a surface layer portion, and a hardness of HV400 to HV550 in a core portion.

10. The carburized steel part according to claim 9, wherein the carburized steel part is a gear.

11. A carburized steel part obtained by subjecting a base material to a cutting operation and a carburizing operation, wherein the base material consists of chemical components of:

C: 0.51 to 0.6% by mass;

Si: 0.01 to 1.5% by mass;

Mn: 0.3 to 2.0% by mass;

P: 0.0001 to 0.02% by mass;

S: 0.001 to 0.15% by mass;

N: 0.001 to 0.03% by mass;

Al: greater than 0.06 but less than or equal to 0.3% by mass; and,

O: 0.0001 to 0.005% by mass, with a balance consisting of iron and inevitable impurities, and wherein the carburized steel part has a hardness of HV550 to HV800 in a surface layer portion, and a hardness of HV400 to HV550 in a core portion.

12. The carburized steel part according to claim 11, wherein the carburized steel part is a gear.

* * * * *